US008046881B2

(12) United States Patent
Johnson et al.

(10) Patent No.: US 8,046,881 B2
(45) Date of Patent: Nov. 1, 2011

(54) CREMATION URN, KIT AND SYSTEM FOR RETAINING CREMATION REMAINS

(76) Inventors: Eugenia L. Johnson, Albuquerque, NM (US); Darrell W. Johnson, Albuquerque, NM (US); James A. Arias, Albuquerque, NM (US)

( * ) Notice: Subject to any disclaimer, the term of this patent is extended or adjusted under 35 U.S.C. 154(b) by 0 days.

(21) Appl. No.: 12/925,801

(22) Filed: Oct. 29, 2010

(65) Prior Publication Data

US 2011/0099778 A1 May 5, 2011

Related U.S. Application Data

(60) Provisional application No. 61/280,300, filed on Nov. 2, 2009.

(51) Int. Cl.
*A61G 17/00* (2006.01)

(52) U.S. Cl. ..... 27/1; 40/124.5

(58) Field of Classification Search ..... 27/1, 35; D99/5; 211/85.27; 40/722, 725, 124.5; 220/23.87
See application file for complete search history.

(56) References Cited

U.S. PATENT DOCUMENTS

| | | | | |
|---|---|---|---|---|
| 3,841,726 | A | 10/1974 | Andros et al. | |
| D237,850 | S | 12/1975 | Booty | |
| D350,010 | S | 8/1994 | May et al. | |
| D359,831 | S | 6/1995 | Parker | |
| D421,672 | S | 3/2000 | Thesken | |
| D432,285 | S | 10/2000 | Baldwin et al. | |
| D433,209 | S | 10/2000 | Baldwin et al. | |
| D436,758 | S | 1/2001 | Rodrigues | |
| D438,362 | S | 2/2001 | Robinson | |
| D438,687 | S | 3/2001 | Robinson | |
| D442,347 | S | 5/2001 | Parker | |
| D444,288 | S | 6/2001 | Robinson | |
| 6,735,831 | B1 | 5/2004 | Greiwe et al. | |
| D494,727 | S | 8/2004 | Poteet | |
| 6,944,921 | B1 | 9/2005 | Gersten | |
| 7,043,803 | B2 * | 5/2006 | Chen | 27/1 |
| D543,005 | S | 5/2007 | Pertz | |
| 7,308,740 | B2 * | 12/2007 | Roberts | 27/1 |

(Continued)

OTHER PUBLICATIONS http://www.urnsplus.com web site, 5 pages, undated.

(Continued)

*Primary Examiner* — William L. Miller
(74) *Attorney, Agent, or Firm* — Kevin Lynn Wildenstein

(57) ABSTRACT

The present invention is a cremation urn and a system for retaining cremation remains, the invention comprising in one embodiment, a top shelf, a bottom shelf and a middle portion defining an artwork channel, recess or void between the top and bottom shelves. In another embodiment, the bottom shelf and the top shelf have a larger surface area than the middle portion so that both the top and bottom shelf protrude further out away from the middle portion. In this regard, the middle portion can then be defined to have a channel of surface space between the top and bottom shelves, so that optional ornamental designs or artwork can be variously, sequentially or randomly coupled to the middle portion's viewable surface area within the artwork channel, recess or void. In another embodiment, the top shelf has a top surface which is adapted to receive and retain optional ornamental designs or artwork. In another embodiment, the artwork recess formed in the urn is covered by a protective sheet which is preferably transparent in nature, to thereby substantially or permanently encapsulate any artwork within the recess for viewing. An optional rotatable base for the urn is also disclosed.

20 Claims, 11 Drawing Sheets

U.S. PATENT DOCUMENTS

| | | | | |
|---|---|---|---|---|
| 7,562,423 | B2 * | 7/2009 | Pryd-Kakuk | 27/1 |
| D609,874 | S * | 2/2010 | Doty | D99/5 |
| D612,571 | S * | 3/2010 | Doty | D99/5 |
| 7,793,393 | B2 * | 9/2010 | Roberts | 27/1 |
| 2006/0174461 | A1 | 8/2006 | Roberts | |
| 2007/0033777 | A1 | 2/2007 | Blessing | |
| 2008/0251480 | A1 | 10/2008 | Roberts | |
| 2009/0030804 | A1 | 1/2009 | Sell | |
| 2010/0058565 | A1 * | 3/2010 | Roberts | 27/1 |

OTHER PUBLICATIONS http://www.davis-whitehall.com web site, 51 pages, undated.

* cited by examiner

CREMATION URN, KIT AND SYSTEM FOR RETAINING CREMATION REMAINS

PRIORITY CLAIM

The present invention claims priority from U.S. Provisional Patent Application No. 61/280,300, filed Nov. 2, 2009 and entitled "Cremation Urn and System for Retaining Cremation Remains".

FIELD OF INVENTION

The present invention relates generally to cremation urns found in the funeral industry, and a novel utilitarian structure, use and various memorialization applications for such urns. The present urn may be used for both human cremation remains (known as "cremains"), as well as other remains (e.g., from a pet or other animal).

BACKGROUND OF THE INVENTION

The business of cremation and placing the cremated remains in an urn is expanding, as it is an inexpensive alternative to typical funeral costs. While there are several cremation urn designs in the funeral industry, consumers are demanding more urns which can be quickly modified to create a uniquely designed cremation urn that commemorates and memorializes their deceased loved one. In this regard, the cremation urn industry has seen a tremendous increase in market presence due to the popularity of a wider variety of choices amongst cremation urns.

Several of these cremation urn designs have resulted in a patent. Thus, for example, U.S. Design Pat. No. 350,010 to May et al. discloses a decorative ornamental four-sided, wooden cremation urn having a pair of columns on each side façade. U.S. Design Pat. No. 359,831 to Parker discloses a ornamental four-sided wooden cremation urn where one façade includes a decorative etched carving. U.S. Design Pat. 421,672 to Thesken discloses an ornamental device for scattering cremation remains. U.S. Design Pat. No. 432,285 to Baldwin et al. discloses an ornamental four-sided, wooden cremation urn having a generally square or box-like appearance having four bumper corners joining each side façade. In contrast, U.S. Design Pat. No. 433,209, also to Baldwin et al. discloses the same ornamental four-sided, wooden cremation urn having a generally square or box-like appearance, but does not claim the four bumper corners joining each side façade found in the previous patent.

Continuing, U.S. Design Pat. No. D438,362 S discloses a four-sided urn having a top surface that slants from back to front. U.S. Design Pat. No. D438,687 S to Robinson discloses an ornamental, wooden cremation urn having a generally rectangular appearance, and includes an ornamental dog picture upon the top surface. U.S. Design Pat. No. D442,347 S to Parker discloses an ornamental cremation urn featuring gardening artwork upon a top surface. U.S. Design Pat. No. D444,288 S to Parker discloses an ornamental square cremation urn featuring decorative columns and bumpers which are surrounded or otherwise encircled by an elongated string, yarn or rope structure. U.S. Design Pat. No. D494,727 S to Poteet discloses a cremation urn featuring a longer height middle portion when compared to either its top portion or its bottom portion, and which is devoid of any artwork. U.S. Design Pat. No. D543,005 S to Pertz discloses a heart-shaped cremation urn, with the heart shape forming all of the top, middle and bottom portions.

U.S. Pat. No. 6,735,831 B1 to Greiwe et al. discloses a cremation urn having a retractable plaque at its base, along with a lid having a transparent top. The top of the urn contains a recess where memorabilia may, be placed, and viewed when the lid is closed. This patent fails to appreciate the use of the other surfaces of the urn as display areas for commemorative purposes or placing of memorabilia.

U.S. Patent Publication No. 2006/0174461 A1 to Roberts discloses a cremation urn having replaceable panels, where each panel is engraved with a design by laser engraving. U.S. Patent Publication No. 2007/0033777 A1 to Blessing discloses a solid surface luminous urn, while U.S. Patent Publication No. 2009/0030804 A1 discloses a method for ordering a customized cremation urn over a computer network.

While increasing demand exists for newer, more modern cremation urns, there is a strong need for a novel cremation urn which is capable of ease of manufacture, ease of storage, and an urn which may be easily modified or otherwise customized in order to memorialize the loved one in a graceful and ornamental manner.

SUMMARY OF THE INVENTION

The following summary of the invention is provided to facilitate an understanding of some of the innovative features unique to the present invention, and is not intended to be a full description of variations that may be apparent to those of skill in the art. A full appreciation of the various aspects of the invention can be gained from the entire specification, claims, drawings, and abstract taken as a whole.

The present invention, in one embodiment, is a cremation remains urn comprising a core receptacle adapted to receive and store a cremation remains container within a hollow interior of the core receptacle, the core receptacle having a top portion, a bottom portion, and a middle portion therebetween, the middle portion having a perimeter that is smaller than the perimeters of the top portion and the bottom portion to thereby define at least one recess therebetween. Preferably, the middle portion is formed as a multi-faceted structure (e.g., multiple side surfaces) adapted to receive and securely retain memorialization items such as, but not limited to, mementos, photographs, medals, plaques, awards, sports items and like artwork which commemorates the life of the deceased loved one. The top portion may also be adapted to receive and securely retain memorialization items.

In another embodiment, the present invention is a cremation urn kit for retaining cremation remains.

In yet another embodiment, generally referred to as the shadowbox embodiment, the present invention discloses a primary transparent sheet, film or pane flushably connecting the top portion and the bottom portion over the middle portion, the sheet or pane being adapted to allow the continuous viewing of the artwork in the middle portion, while also serving to preserve the integrity of the artwork secured therein.

In still another embodiment, an optional rotatable base is included which rotatably supports the receptacle core, or otherwise is securely attachable to the receptacle core to thereby allow viewing of the memorialization elements on all facades of the urn.

The present invention thus provides an elegant and graceful cremation urn with memorialization features built in to the function of the urn.

The novel features of the present invention will become apparent to those of skill in the art upon examination of the following detailed description of the preferred embodiment or can be learned by practice of the present invention. It should be understood, however, that the detailed description of the preferred embodiment and the specific examples presented, while indicating certain embodiments of the present invention, are provided for illustration purposes only because various changes and modifications within the spirit and scope of the invention will become apparent to those of skill in the art from the detailed description, drawings and claims that follow.

BRIEF DESCRIPTION OF THE DRAWINGS

The accompanying figures further illustrate the present invention and, together with the detailed description of the preferred embodiment, assists to explain the general principles according to the present invention.

Additional aspects of the present invention will become evident upon reviewing the non-limiting embodiments described in the specification and the claims taken in conjunction with the accompanying figures, wherein like reference numerals denote like elements.

Upon review of the present disclosure, those of skill in the art will realize that the present invention may be embodied as a system, kit, assembly, process or apparatus. Other variations and modifications of the present invention will be apparent to those of ordinary skill in the art, and is not limited except by the appended claims. The particular designs and configurations discussed herein can be varied, and are cited to illustrate particular embodiments of the present invention. It is contemplated that the use of the present invention can involve components having different characteristics as long as the principles disclosed herein are followed.

DETAILED DESCRIPTION OF THE PREFERRED EMBODIMENT

The present invention is a cremation urn adapted to securely retain various artwork on one or more surfaces.

Turning to FIGS. 1*a*-1*f*, a cremation urn 100 is disclosed embodying several features of the present invention. The urn 100 comprises a core receptacle which is formed from three primary components, namely, a top portion 110, a bottom portion 120 adapted to sit upon a flat surface, and a multi-faceted middle portion 130 therebetween, all in structural communication to form the urn's core receptacle. Those of skill in the art will realize that while three primary components are disclosed, the three primary components may be formed from an integral article, such as formation by a plastic mold, or formation from a single slab of granite, thereby resulting in a single structure core receptacle.

Figure 1A:
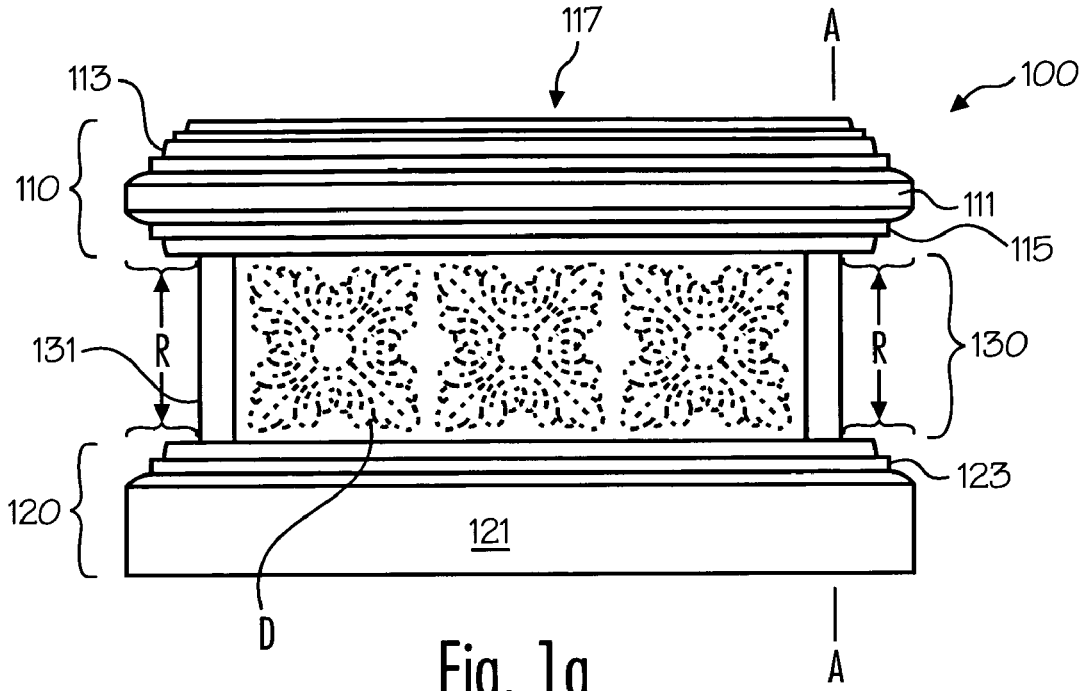
FIG. 1*a* illustrates a front side view of one exemplary embodiment of the present invention, the rear side view being a mirror image of the front side view.
Figure 1B:
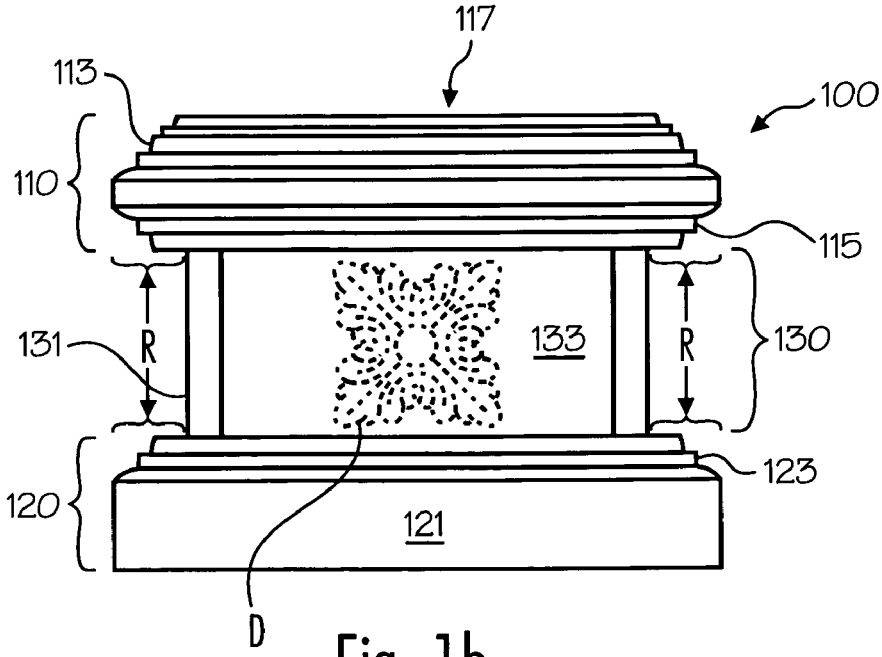
FIG. 1*b* illustrates a left side view of the invention shown in FIG. 1*a*, the right side view being a mirror image of the left side view.
Figure 1C:
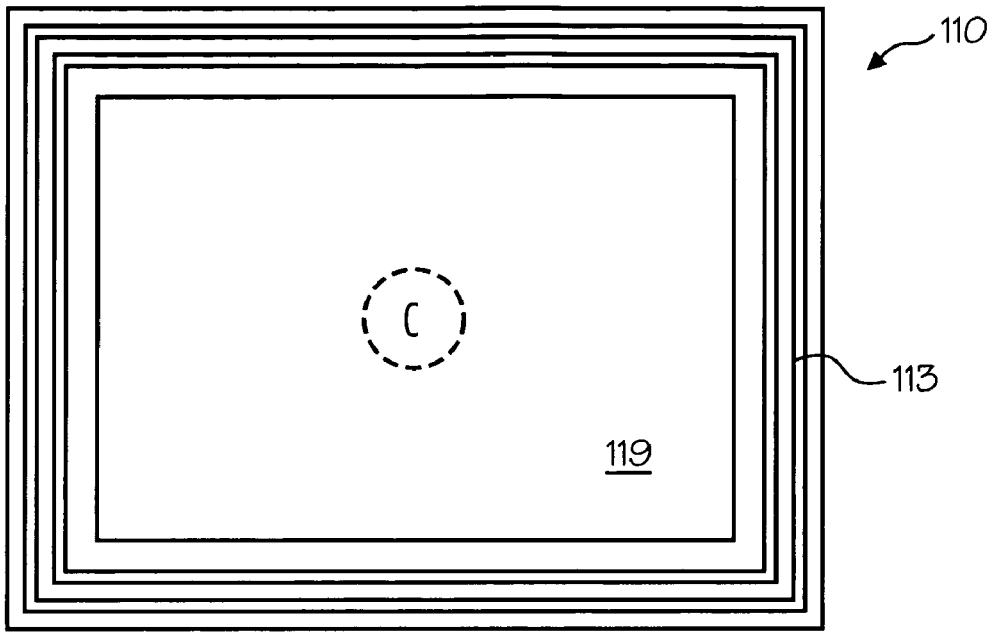
FIG. 1*c* illustrates a top side view of the invention shown in FIG. 1*a;*
Figure 1D:
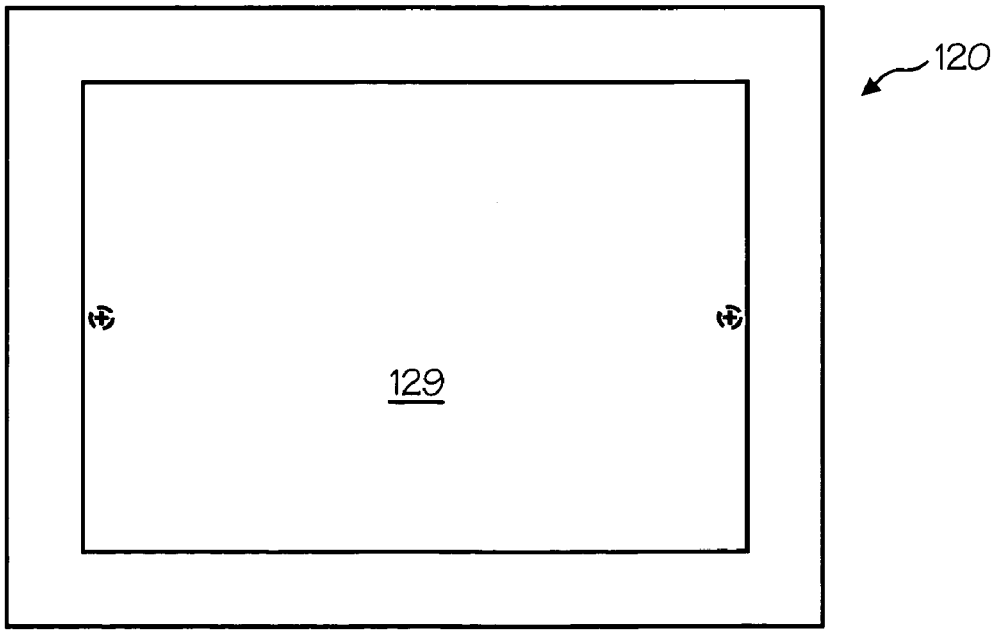
FIG. 1*d* illustrates a bottom side view of the invention shown in FIG. 1*a;*
Figure 1E:
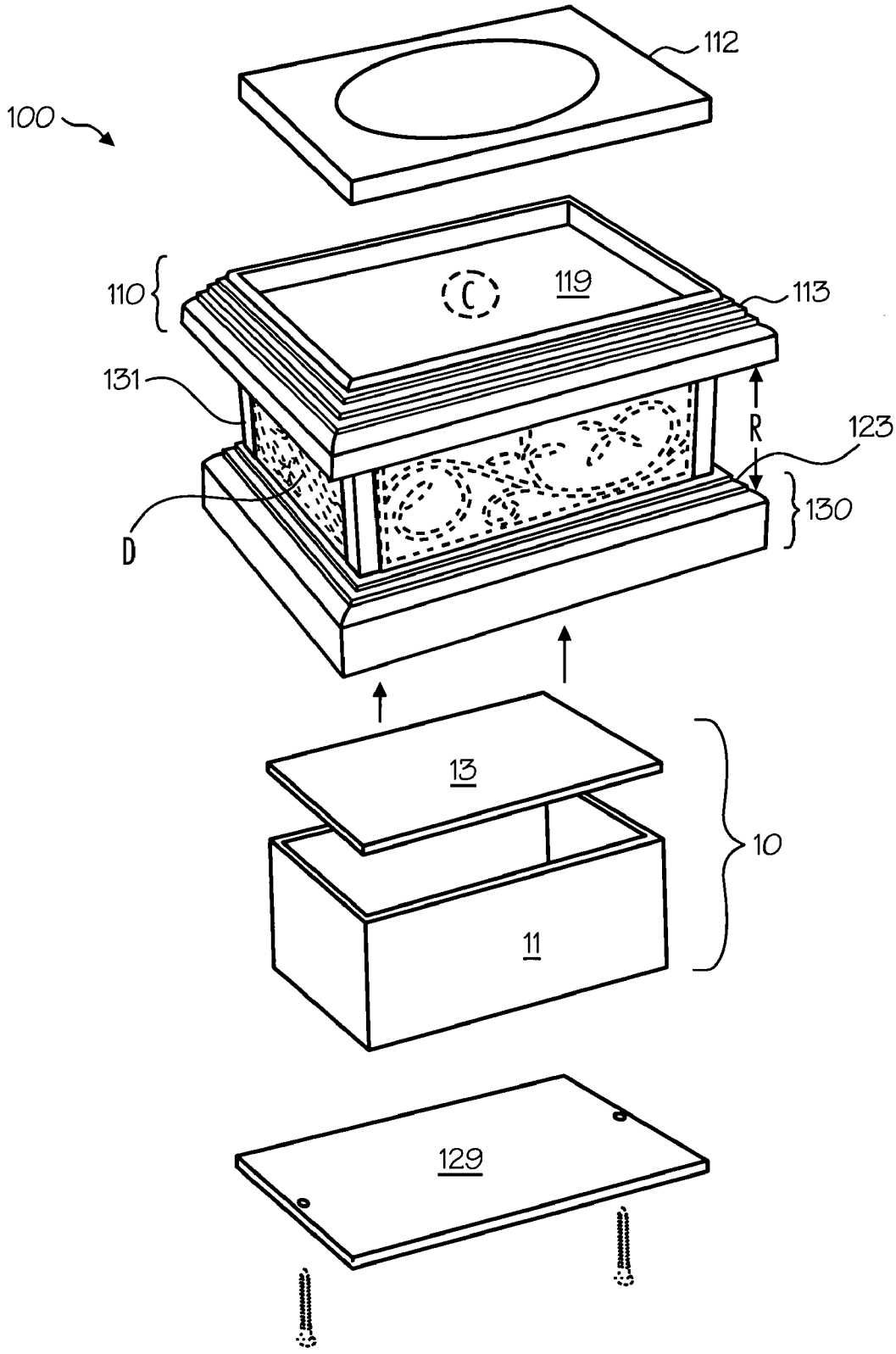
FIG. 1*e* illustrates a top side perspective exploded view of the invention shown in FIGS. 1*a*-1*d;*
Figure 1F:
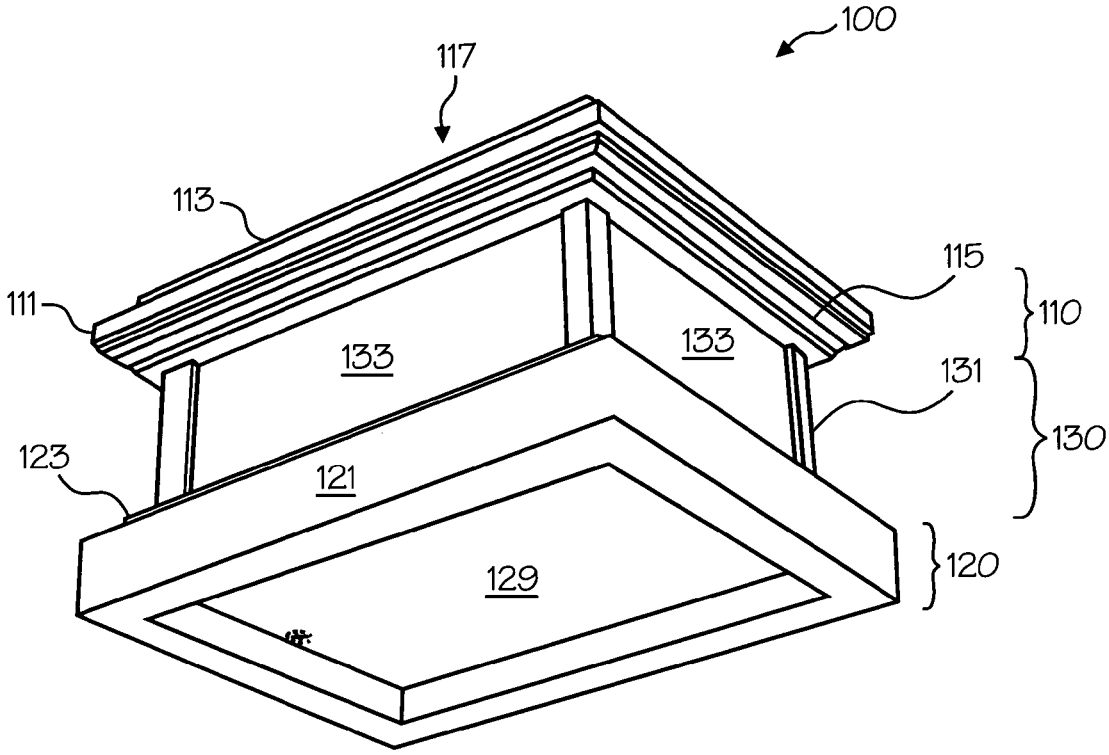
FIG. 1*f* illustrates a bottom side perspective view of the invention shown in FIGS. 1*a*-1*d;*
Figure 1G:
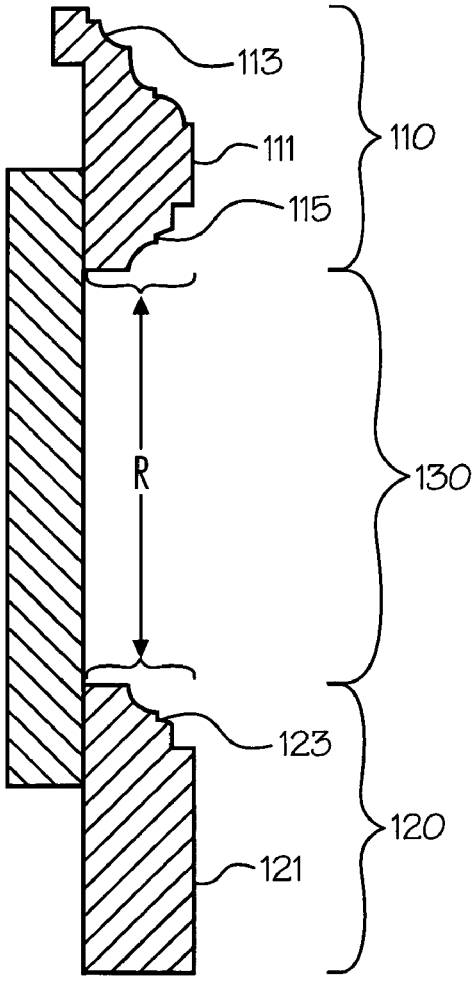
FIG. 1*g* illustrates an exemplary side cutaway of the middle portion of the invention shown in FIG. 1*a* along line A-A without any artwork or decorative ornamentation disposed in the recess thereon.
Figure 1H:
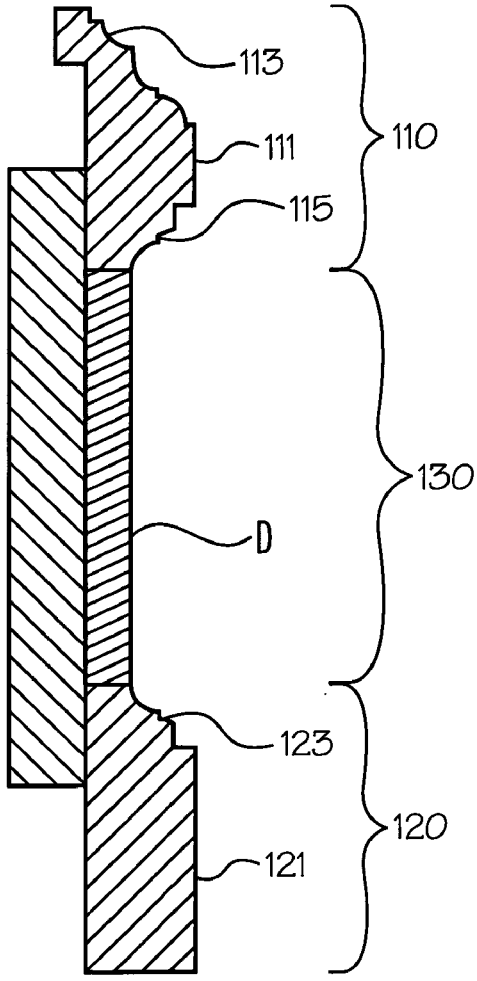
FIG. 1*h* illustrates an exemplary side cutaway of the middle portion of the invention shown in FIG. 1*a* along line A-A with an exemplary artwork substrate (e.g., fretwork) or decorative ornamentation disposed in the recess thereon.

In one embodiment, the top portion 110 comprises a top surface substrate 111 preferably having at least one inwardly ascending shelf perimeter 113 (e.g., ascending towards the center C of the core receptacle, as generally indicated in FIGS. 1*c* and 1*e*) on a top side, and at least one inwardly descending shelf perimeter 115 (e.g., descending towards the center of the core receptacle) on the other side adjacent the middle portion 130. The ascending and descending shelves may be formed from a single element (such as by carving a block of wood or stone as desired), or, by laying multiple sheets of the desired element one upon the other to achieve a layered (or, stair step) look. Optionally, the bottom portion 120 further includes at least one inwardly ascending perimeter shelf 123 on a top side perimeter as shown in the attached drawings. Thus, this embodiment of the present invention allows for various perimeter molding and edge profiles to be formed on the top portion 110 or the bottom portion 120 as desired.

The core receptacle may be formed (whether integrally or separately) of any conventional material (such as, for example, natural stone, any number of plastics, steel or any combination thereof), but in one preferred embodiment, the material may be made of wood. While the middle portion is multi-faceted, preferably, the middle portion has at least four surfaces as depicted in the attached drawings. Because of the novel, but simplistic design of the present invention, the core receptacle may be easily mass manufactured and stored for later modification by the end user (e.g., by adding additional artwork as disclosed herein).

In one embodiment, the top shelf 110 and the bottom shelf 120 have selectively larger perimeter portion surfaces 111, 121 respectively than the perimeter of one or more of the surfaces 133 of middle portion 130 so that both the top and bottom shelf perimeter portion surfaces 111, 121 selectively protrude further out and away from selective sides of the middle portion surface 133 (as seen, for example, in FIG. 1*a*). This means that the disclosed artwork D may be coupled to one or more predetermined side surfaces 133 of the middle portion 130, so that not all side surfaces 133 are required to receive and securely retain artwork.

Preferably, the top shelf's perimeter portion surface area 111 is substantially if not entirely equivalent to the bottom shelf's perimeter portion 121. In this regard, the top shelf's perimeter portion 111 will have substantially the same width and length as the bottom shelf's perimeter portion 121. It is these perimeter portions which help create and define the recess area R as shown in the figures. Additionally, the top surface plane is preferably substantially or fully parallel to the bottom surface plane.

In a preferred embodiment, the middle portion's surface 130 may be said to be recessed or have a recessed surface area in relation to the top shelf portion's 110 and the bottom shelf portion's 120 perimeter. In this regard, the middle portion 130 can then be defined to have a recess, channel, space or void (generally identified as "R" in the drawings) between the top 110 and bottom 120 shelves, so that optional ornamental designs or artwork D can be variously, sequentially or randomly coupled to the middle portion's viewable surface area 133. Thus, for example, the dashed line rendition of flowers D shown in the Figures is exemplary three dimensional artwork which may be permanently secured to any one of the middle portion surfaces 133. Other exemplary artwork which may adorn selective areas of the middle portion's surfaces include, but are not limited to, mementos, photographs, medals, awards, like artwork which commemorates the life of the loved one, and any combination thereof. This primary artwork may be of any variety, of either two-dimensional or three-dimensional artwork, and be made from any type of available material. Thus, the artwork could also include (without limitation) wood carvings, metal carvings, jewelry or jewels, sports memorabilia, plaques, natural materials, leather, paper, plastics, or any combination thereof.

Those of skill in the art will now appreciate that the present invention's core receptacle may be easily manufactured and stored without any adornments. As orders arise, the present invention may be adorned as described herein at the manufacturing site, or, the present invention may be shipped to a remote location (such as a funeral home, for example), where the core receptacle may then be adorned or customized as disclosed herein. This approach is cost effective, as it does not require the manufacturer to store an inventory of a large number of urns having the various artwork already adorned. Moreover, the artwork may be designed to be removable from the core receptacle, which is especially useful should the artwork be defective, or should the artwork be found undesireable by the end user.

In order to define a cremation urn system, the middle portion 130 includes a hollow interior (not shown, but generally understood by those of skill in the art) adapted to receive and store a cremation remains container (e.g., element 10 in FIG. 1*e*) which is typically formed from a remains box 11 adapted to securely couple to a lid 13, thereby forming the cremation remains container 10. While container 10 is illustrated as generally a rectangular box in the Figures, the container 10 may actually be formed in any shape and material so long as it securely stores the cremation remains. Additionally, those of skill in the art will recognize that container 10 may also be defined by one or more compartments to store one or more cremains (e.g., a two compartment container for a husband and wife) in the urn. The urn's bottom portion 120 includes a hollow interior portion (not shown) which is covered by a bottom lid 129, the hollow interior portion being preferably dimensionally sized to receive the cremation remains container 10, and therefore, being in substantial registration with the middle portion's hollow interior so that the void created by the hollow interiors thereby define a cremains receiving port in the urn 100.

While the attached drawings illustrate that the lid 129 is secured to the bottom portion 120 through two representative screws, those of skill in the art will realize that any conventional removable or permanent securing means may be used to secure the lid 129 to the bottom portion 120 (such as, for example, numerous screws, nails, Velcro, welds, glue, solder or other like adhesives, so that the exact method of securing is merely a design choice). Preferably, the interior surfaces surrounding the void may be adorned with Interior flocking, acrylic flocking, velvet flocking or like soft coating material to help protect and stabilize the internal cremation remains container 10. Additionally, the cremation remains container 10 may be formed of any conventional material which has been approved for such use by any governmental authority, but preferably, the container 10 is formed from plastic, acrylic or metal and includes a self-sealing lid 13.

Preferably, as seen in FIGS. 1*a*, 1*b* and 1*e*, a plurality of decorative or plain bumpers 131 may optionally be secured to selected corners adjacently formed in the middle portion 130. The optional bumpers 131 are primarily adapted to partially or fully cover selected corners. However, if used, bumpers 131 may also be adapted to provide an ornamental embellishment, or otherwise, may also serve to support the top portion 110 upon the bottom portion 120.

In another embodiment, the top surface 117 of the top shelf portion 110 may also include a receptacle area 119 adapted to receive at least one topside artwork or ornamentation thereon (for example, element 112 in FIG. 1*e*). Thus, the receptacle area 119 can receive, for example, a granite ornamentation, a marble ornamentation, an acrylic ornamentation, a wooden ornamentation or any like ornamentation. This ornamentation 112 may be sized to fit exactly within the receptacle 119, the ornamentation 112 may be thinner, smaller, or it may be of larger width (in which case, the ornamentation will extend away from or jut out away from the receptacle). The receptacle 119 may also receive and retain a piece of artwork (such as a wood carving, or an ornamental art piece such as a small sculpture). Additionally, in another embodiment, the same artwork that is coupled or adorned to the middle portion's surface 133 may be the same or substantially similarly themed artwork that is coupled to the top shelf's top surface receptacle 119. Thus, for example, if the deceased was a member of the military, military artwork may be placed on the top shelf's top surface which has a similar military theme as the artwork placed on the middle portion's surface. As another example, if the deceased loved animals, animal artwork may be placed on the top shelf's top surface which has a similar animal theme as the artwork placed on the middle portion's surface.

In still another embodiment, the present invention is a system or kit of three primary exterior components—a top shelf 110, a bottom shelf 120 and a middle portion 130 between the top and bottom shelves defining a cremation urn without any artwork, ornamentation and/or bumpers. As part of the system or kit, additional or optional artwork, ornamentation and/or bumpers may be included with the cremation urn as a system or kit, so that an end user may selectively combine the cremation urn with the artwork as desired on any preselected surface 133. As those of skill in the art will recognize, the individual parts disclosed herein may be later combined to form the system or kit. This embodiment may be advantageous to industry professionals, who can order the cremation urn separately from the artwork or ornamentation. And, when necessary, the industry professionals can order the artwork or ornamentation separately apart from the cremation urn, and have the ability to combine the system or kit with the artwork as the market dictates. The present invention allows for flexibility of types and sizes of artwork materials which may be used to embellish the surface of the urn.

Turning now to FIGS. 2*a*-2*g*, another embodiment of the present invention is shown which mimics a shadowbox. A shadowbox is generally known as an enclosed case typically used in dioramas with one or more scenes or objects that allows light to pass through, so that objects within the enclosed case are less susceptible to damage from light and are protected. In this regard, another embodiment of the present invention teaches the use of a, primary transparent sheet, film or pane 231 flushably connecting the top portion 210 and the bottom portion 220 over the middle portion 230, the sheet or pane 231 being adapted to allow the continuous viewing of the artwork 231 in the middle portion 230, while also serving to preserve the integrity of the artwork secured on the middle portion's surface 233. The pane 231 thus provides visual access to the artwork secured in the middle portion 230. Optionally, the surface 233 of middle portion 230 may be bare, may be adorned with artwork D, or may be adorned with a decorative lining, such as, for example, velvet lining, either alone or in combination with the artwork D. This shadowbox embodiment may be especially desired as a cremation urn for deceased members of the military. In this embodiment, the shadow boxes may contain the various medals and awards a person has earned through a military career, and their final badge of rank.

Thus, similar to the embodiment shown in FIGS. 1*a*-1*h*, a cremation urn 200 is disclosed is shown in FIGS. 2*a*-2*g* embodying several features of the present invention. The urn 200 comprises a core receptacle which is formed from three primary components, namely, a top portion 210, a bottom portion 220 adapted to sit upon a flat surface, and a multifaceted middle portion 230 therebetween, all in structural communication to form an urn body or the core receptacle.

Figure 2A:
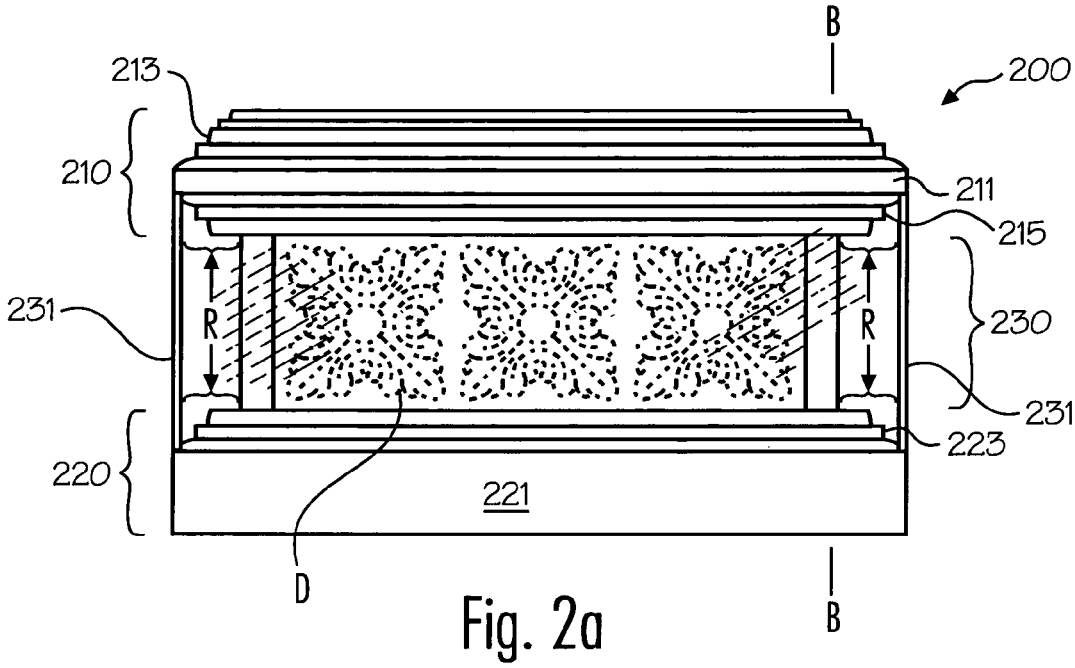
FIG. 2*a* illustrates a front side view of another exemplary embodiment of the present invention, the rear side view being a mirror image of the front side view.
Figure 2B:
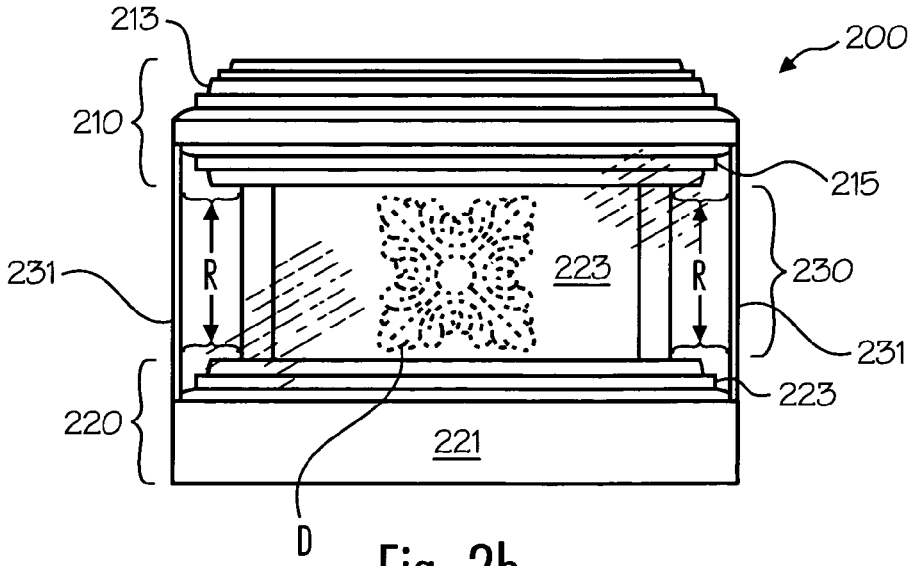
FIG. 2*b* illustrates a left side view of the invention shown in FIG. 2*a*, the right side view being a mirror image of the left side view.
Figure 2C:
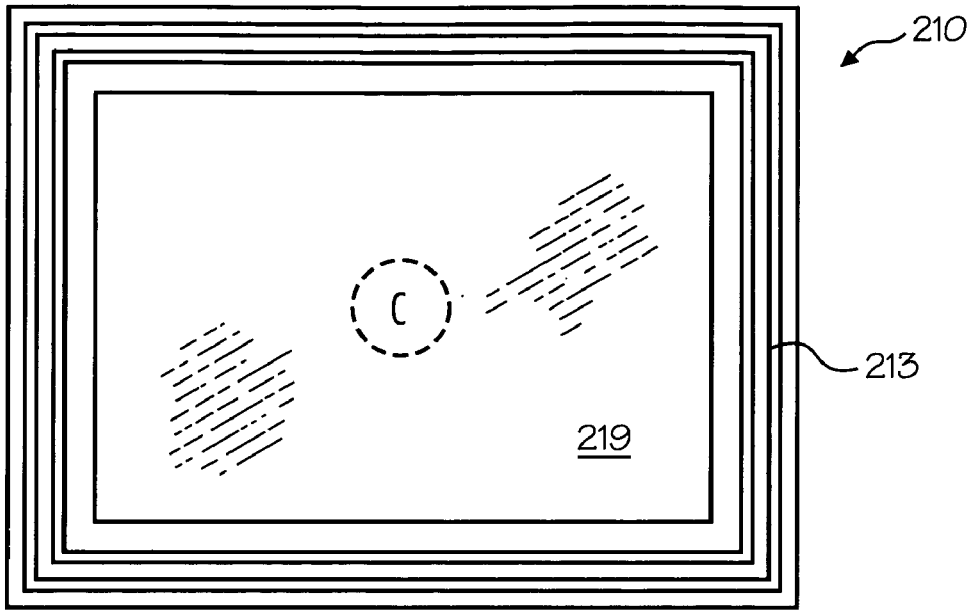
FIG. 2*c* illustrates a top side view of the invention shown in FIG. 2*a;*
Figure 2D:
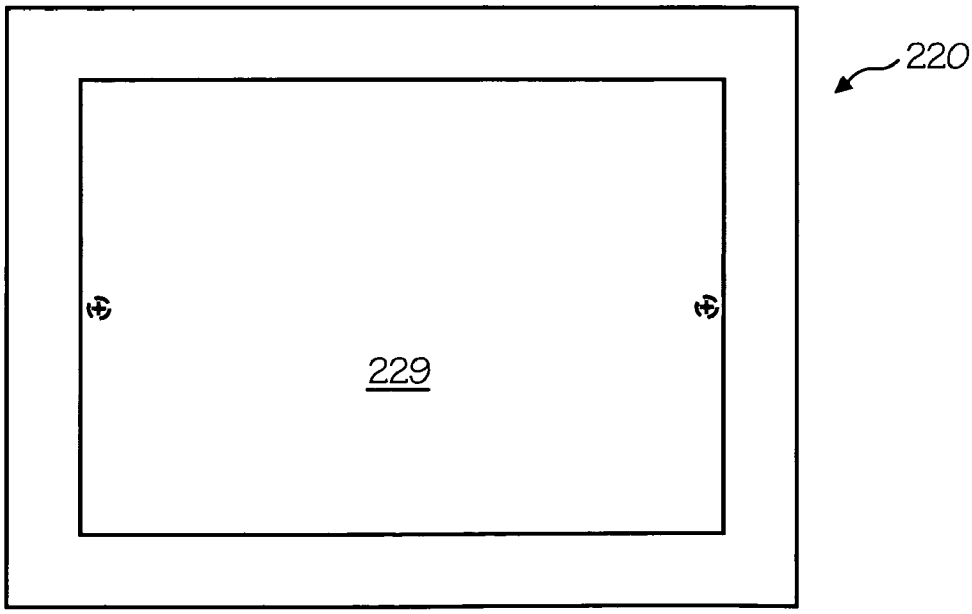
FIG. 2*d* illustrates a bottom side view of the invention shown in FIG. 2*a;*
Figure 2E:
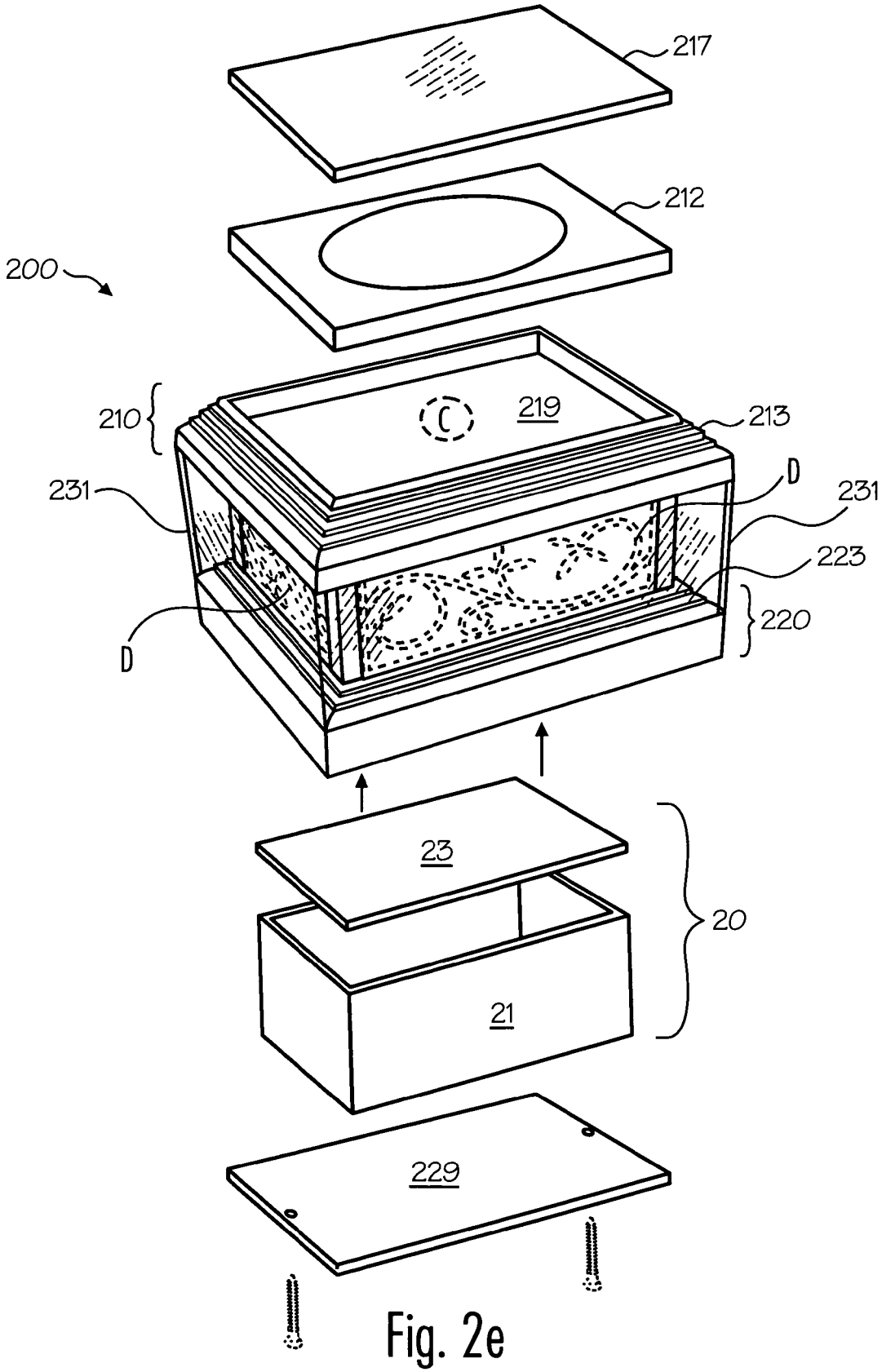
FIG. 2*e* illustrates a top side perspective exploded view of the invention shown in FIGS. 2*a*-2*d;*
Figure 2F:
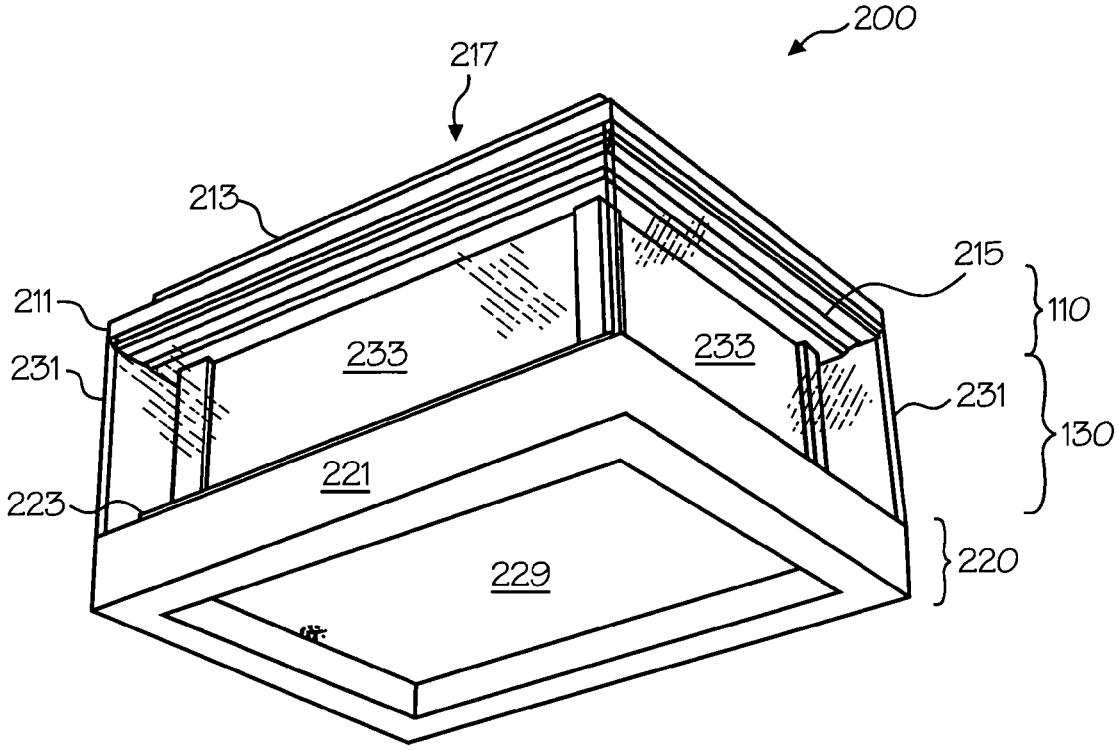
FIG. 2*f* illustrates a bottom side perspective view of the invention shown in FIGS. 2*a*-2*d;*
Figure 2G:
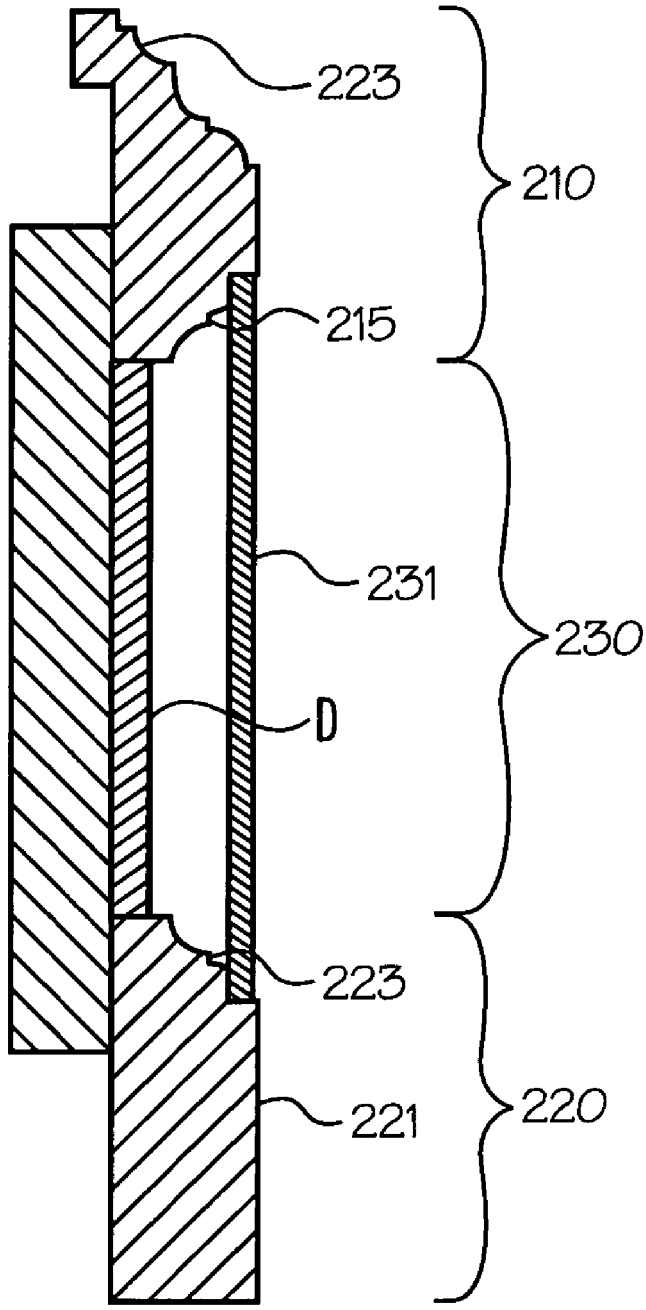
FIG. 2*g* illustrates a illustrates an exemplary side cutaway of the middle portion of invention shown in FIG. 2*a* along line B-B with an exemplary artwork substrate (e.g., fretwork) or decorative ornamentation and transparent pane disposed thereon.

In one embodiment, the top portion 210 comprises a top surface substrate 211 preferably having at least one inwardly ascending shelf perimeter 213 (e.g., ascending towards the center C of the core receptacle, as generally indicated in FIGS. 2*c* and 2*e*) on a top side, and at least one inwardly descending shelf perimeter 215 (e.g., descending towards the center of the core receptacle) on the other side adjacent the middle portion 230. The ascending and descending shelves may be formed from a single element (such as by carving a block of wood or stone as desired), or, by laying multiple sheets of the desired element one upon the other to achieve a layered (or, stair step) look. Optionally, the bottom portion 220 further includes at least one inwardly ascending perimeter shelf 215 on a top side perimeter as shown in the attached drawings. Thus, this embodiment of the present invention allows for various molding and edge profiles to be formed on the top portion 210 or the bottom portion 220 as desired.

In one embodiment, the top shelf 210 and the bottom shelf 220 have larger perimeter portion surfaces 211, 221 respectively than the perimeter of the surfaces of middle portion 230 so that both the top and bottom shelf perimeter portion surfaces 211, 221 protrude further out and away, from the middle portion 230 surface (as seen, for example, in FIG. 1*a*). Preferably, the top shelf's perimeter portion surface area 211 is substantially if not entirely equivalent to the bottom shelf's perimeter portion 221. In this regard, the top shelf's perimeter portion 211 will have substantially the same width and length as the bottom shelf's perimeter portion 221. It is these perimeter portions which help create and define the recess R as shown in FIGS. 2*a*-2*g*. These perimeter portions are also used to define the preselected placement of the transparent pane 231. Additionally, the top surface plane is preferably substantially or fully parallel to the bottom surface plane.

In a preferred embodiment, the middle portion's surface 230 may be said to be recessed or have a recessed surface area in relation to the top shelf portion's 210 and the bottom shelf portion's 220 perimeter. In this regard, the middle portion 230 can then be defined to have a recess, channel, space or void (again, generally identified as "R" in the drawings) between the top 210 and bottom 220 shelves, so that optional ornamental designs or artwork D can be variously, sequentially or randomly coupled to the middle portion's viewable surface area 233 through pane 231.

Again, in order to define a cremation urn system, the middle portion 230 includes a hollow interior (not shown, but generally understood by those of skill in the art) adapted to receive and store a cremation remains container (e.g., element 20 in FIG. 2*e*) which is typically formed from a remains box 21 adapted to securely couple to a lid 23, thereby forming the cremation remains container 10. While container 20 is illustrated as generally a rectangular box in the Figures, the container 20 may actually be formed in any shape and material so long as it securely stores the cremation remains. The bottom portion 220 includes a hollow interior portion (not shown) which is covered by a bottom lid 229, the hollow interior portion being preferably dimensionally sized to receive the cremation remains container 20, and therefore, being in substantial registration with the middle portion's hollow interior so that the void created by the hollow interiors thereby define a cremains receiving port in the urn 200.

Preferably, as seen in FIGS. 2*a*, 2*b* and 2*e*, a plurality of decorative or plain bumpers 231 may optionally be secured to selected corners formed in the middle portion 230. The optional bumpers 231 are primarily adapted to partially or fully cover selected corners and are viewable through pane 231. However, if used, bumpers 231 may also be adapted to provide an ornamental embellishment, or otherwise, may also serve to support the top portion 210 upon the bottom portion 220. Moreover, the areas where the transparent panes 231 are coupled together may be covered by bumpers (not shown) as desired.

Again, in another embodiment, the top surface of the top shelf portion 210 may also include a receptacle area 219 adapted to receive at least one topside artwork or ornamentation thereon (for example, element 212 in FIG. 2*e*), and which may be partially or substantially covered by an optional secondary transparent pane 217. Thus, the receptacle area 219 can receive, for example, a granite ornamentation, a marble ornamentation, an acrylic ornamentation, a wooden ornamentation, a plastic ornamentation or any like ornamentation or combination of ornamentations. This ornamentation 212 may be sized to fit exactly within the receptacle 219, the ornamentation 212 may be thinner, or it may be of larger width (in which case, the ornamentation will extend away from or jut out away from the receptacle). The receptacle 219 may also receive and retain a piece of artwork (such as a wood carving, or an ornamental art piece such as a small sculpture). Still, in another embodiment, the same artwork that is coupled or adorned to the middle portion's surface as optionally shown in FIGS. 2*a*-2*g* may be the same or substantially similarly themed artwork that is coupled to the top shelf's top surface.

It should be appreciated that the particular implementations disclosed herein are illustrative of the invention and its best mode, and are not intended to otherwise limit the scope of the present invention in any way. Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims. As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or " critical".

Figure 3A:
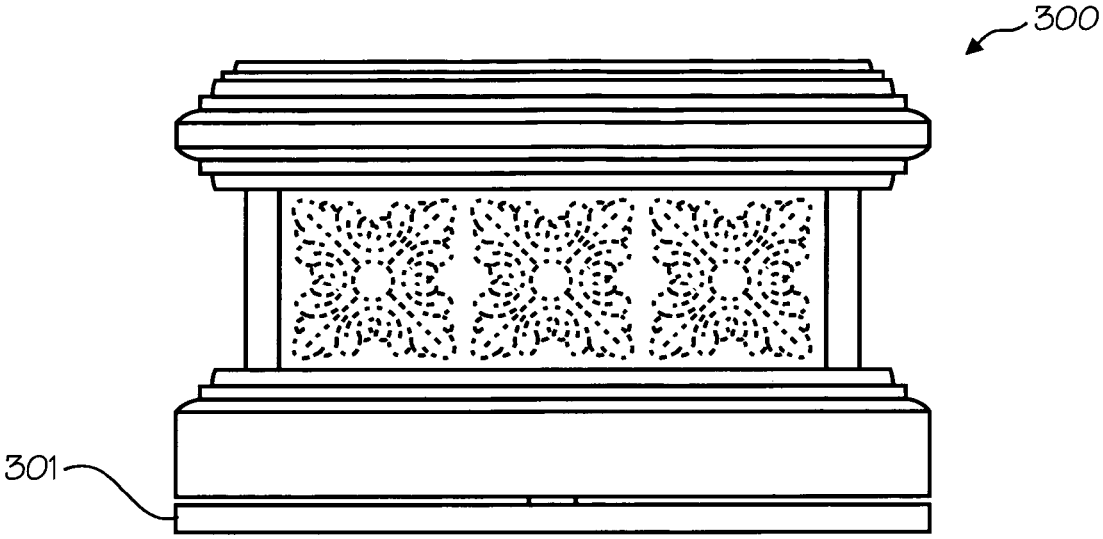
FIG. 3*a* illustrates an optional rotatable base adapted to be securely attachable to the receptacle core disclosed as part of the present invention.
Figure 3B:
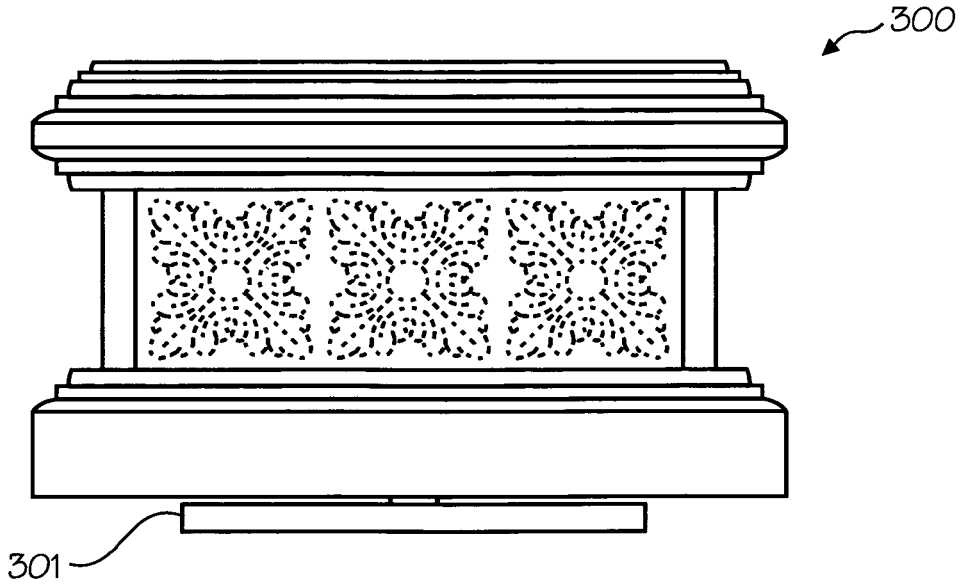
FIG. 3*b* illustrates another optional base adapted to rotatably support the receptacle core disclosed as part of the present invention.

Thus, it is contemplated that the various urn embodiments disclosed may be optionally able to sit upon, or be securely attached to, a rotatable base. Thus, as seen in FIG. 3*a*, a square rotatable base 301 is shown. A square rotatable base may be desired by those end users who desire a synchronous look (e.g., a square rotatable base with a similarly shaped urn). Alternatively, as seen in FIG. 3*b*, a round rotatable base 301 is shown, which may appeal to another class of end users. The actual geometric shape of base 301 is not important; rather, the base is preferably rotatable in order to allow a person to view all artwork adorned in the middle portion effortlessly.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims. As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical".

Other variations and modifications of the present invention will be apparent to those of ordinary skill in the art, and it is the intent of the appended claims that such variations and modifications be covered. The particular values and configurations discussed above can be varied, are cited to illustrate representative embodiments of the present invention and are not intended to limit the scope of the invention. It is contemplated that the use of the present invention can involve components having different characteristics as long as the principle is followed.

We claim:

1. A cremation remains urn comprising:

primary artwork, a core receptacle having a top portion, and bottom portion, and a multi-faceted middle portion therebetween, the top portion, bottom portion and middle portion all being in structural communication, the top portion having a shelf, the top portion shelf comprising at least one inwardly ascending, perimeter stair step layer portion on a top side of the top portion, the bottom portion having a bottom shelf, the top portion shelf and the bottom shelf having larger perimeter portion surfaces than a perimeter of a surface of middle portion so that both the top and bottom shelf perimeter portion surfaces protrude away from the middle portion surface to thereby define a recessed area on and adjacent to the middle portion's surface, the middle portion's surface selectively receiving and securely retaining the primary artwork in the recessed area, the middle portion further comprising a hollow interior, the bottom portion further comprising a hollow interior portion covered by a bottom lid, the middle portion's hollow interior and the bottom portion's hollow interior portion both being in substantial registration to create a void, the void adapted to receive and store a cremation remains container.

2. The urn of claim 1, the top portion shelf further comprising at least one inwardly descending perimeter stair step layer portion on a bottom side of the top portion, and wherein the top portion shelf's perimeter portion is substantially equivalent to the bottom shelf's perimeter portion.

3. The urn of claim 2, the top side of the top shelf portion shelf further comprising a receptacle area adapted to receiving and securely store topside artwork thereon.

4. The urn of claim 3 wherein any theme of the topside artwork and any theme of the primary artwork are substantially similar.

5. The urn of claim 1 further comprising the cremation remains container adapted to fit within the void.

6. The urn of claim 1 wherein selected adjoining facets of the middle portion are selectively covered by one or more bumpers.

7. The urn of claim 1 further comprising a rotatable base, the rotatable base being coupled to the bottom portion.

8. A cremation remains urn kit comprising:

a core receptacle having a top portion having a top shelf, a bottom portion having a bottom shelf, and a multi-faceted middle portion therebetween, the top portion, bottom portion and middle portion all being in structural communication, the middle portion further comprising a hollow interior, the bottom portion further comprising a hollow interior portion covered by a bottom lid, the middle portion's hollow interior and the bottom portion's hollow interior portion both being in substantial registration to create a void, the void adapted to receive and store a cremation remains container, and primary artwork, wherein the top shelf and the bottom shelf both have larger perimeter portion surfaces than a perimeter of any surface of middle portion so that both the top and bottom shelf perimeter portion surfaces protrude away from selective middle portion surfaces to thereby define a selective recessed area on and adjacent to the middle portion's surface, the selective middle portion's surfaces adjacent to the selective recessed area selectively receiving and securely retaining the primary artwork in the recessed area.

9. The kit of claim 8, the top shelf comprising at least one inwardly descending perimeter stair step layer portion on a bottom side of the top portion, the bottom shelf comprising at least one inwardly ascending perimeter stair step layer portion on a top side of the bottom portion.

10. The kit of claim 8, the top shelf comprising at least one inwardly ascending perimeter stair step layer portion on a top side of the top portion, the top shelf further comprising at least one inwardly descending perimeter stair step layer portion on a bottom side of the top portion.

11. The kit of claim 10, the bottom shelf comprising at least one inwardly ascending perimeter stair step layer portion on a top side of the bottom portion.

12. The kit of claim 11 wherein selected adjoining facets of the middle portion are covered by one or more bumpers.

13. The kit of claim 10 wherein the top shelf's perimeter portion is substantially equivalent to the bottom shelf's perimeter portion.

14. A cremation remains urn system comprising:

a core receptacle having a top portion, and bottom portion, and a multi-faceted middle portion therebetween, the top portion, bottom portion and middle portion all being in structural communication, the top portion having at least one shelf, the bottom portion having a bottom shelf, the top shelf and the bottom shelf having larger perimeter portion surfaces than a perimeter of a surface of middle portion so that both the top and bottom shelf perimeter portion surfaces selectively protrude away from one or more selective middle portion surfaces to thereby define a predetermined recessed area on and adjacent to the middle portion's surface, the middle portion's surface adapted to selectively receive and securely retain primary artwork in the recessed area, the middle portion further comprising a hollow interior, the bottom portion further comprising a hollow interior portion covered by a bottom lid, the middle portion's hollow interior and the bottom portion's hollow interior portion both being in substantial registration to create a void, the void adapted to receive and store a cremation remains container, and a primary transparent pane flushably connecting the top portion shelf and the bottom portion shelf over the middle portion, the primary transparent pane adapted to allow the continuous viewing of the primary artwork in the middle portion, while also serving to preserve the integrity of the artwork secured therein.

15. The system of claim 14, the top portion further comprising a top side, the top side further comprising a receptacle area adapted to receiving and securely store topside artwork thereon.

16. The system of claim 15, the top portion further comprising a secondary transparent pane adapted to cover the topside artwork.

17. The system of claim 15 wherein any theme of the topside artwork and any theme of the primary artwork are substantially similar.

18. The system of claim 14 wherein selected adjoining facets of the middle portion are covered by one or more bumpers.

19. The system of claim 14, the top shelf comprising at least one inwardly ascending perimeter stair step layer portion on a top side of the top portion, and the bottom shelf comprising at least one inwardly ascending perimeter stair step layer portion on a top side of the bottom portion.

20. The system of claim 14 wherein the top shelf's perimeter portion is substantially equivalent to the bottom shelf's perimeter portion.

* * * * *